US010814645B2

(12) United States Patent
Ismail

(10) Patent No.: US 10,814,645 B2
(45) Date of Patent: Oct. 27, 2020

(54) METHOD FOR FLAG CUSTOMIZATION

(71) Applicant: Mazen Ismail, San Diego, CA (US)

(72) Inventor: Mazen Ismail, San Diego, CA (US)

( * ) Notice: Subject to any disclaimer, the term of this patent is extended or adjusted under 35 U.S.C. 154(b) by 0 days.

(21) Appl. No.: 16/196,808

(22) Filed: Nov. 20, 2018

(65) Prior Publication Data

US 2020/0156388 A1 May 21, 2020

(51) Int. Cl.

| | |
|---|---|
| ***B41J 3/407*** | (2006.01) |
| ***B41J 2/21*** | (2006.01) |
| ***G09F 17/00*** | (2006.01) |
| ***B41J 2/05*** | (2006.01) |

(52) U.S. Cl.

CPC ..... *B41J 3/4078* (2013.01); *B41J 2/05* (2013.01); *B41J 2/21* (2013.01); *G09F 17/00* (2013.01); *G09F 2017/0033* (2013.01)

(58) Field of Classification Search

CPC ..... B41J 2/2114; B41J 3/4078; D06P 5/30; D06P 5/001; G09F 17/00; G09F 2017/0033

USPC ..... 347/96, 100; 116/31.6, 173

See application file for complete search history.

(56) References Cited

U.S. PATENT DOCUMENTS

| | | | |
|---|---|---|---|
| 8,328,339 | B2 | 12/2012 | Grasselli |
| 2003/0217685 | A1 | 11/2003 | Aldridge |

FOREIGN PATENT DOCUMENTS

| | | | |
|---|---|---|---|
| WO | WO2008/010705 | A1 | 1/2008 |

*Primary Examiner* — An H Do

(74) *Attorney, Agent, or Firm* — Omni Legal Group; Omid E. Khalifeh; Lara A. Petersen

(57) ABSTRACT

A method is provided which enables the printing of a desired design on a flag or other textile material having a previously existing design thereon or that which does not. Providing a textile material, such as a flag; treating the textile material by removing any excess thread and hemming; preparing at least one printing paste; printing the printing paste on the textile material in a desired design through digital printing, screen printing, or heat transfer printing; and then fixing the desired design on the textile material, in accordance with embodiments of the method, may allow versatility and customization of flags and further allow consumers to personalize known flag designs.

9 Claims, 7 Drawing Sheets

METHOD FOR FLAG CUSTOMIZATION

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to a method for customizing flags and, more particularly, to a method for printing unique designs on flags with previously existing designs and those without.

BACKGROUND

A flag may be defined as a piece of fabric or textile material with distinctive colors, symbols, indicia, markings, or other designs thereon. Flags can be used as a signaling device, a symbol, or even for decoration. One of the most popular uses of a flag is to symbolize allegiance to a nation, country, organization, or other common interest group. As one example, the flag of Denmark is the oldest national flag remaining in use and features a vibrant red as the background with a stark white cross extending to the edges of the flag. In another instance, the American flag features 50 stars representing the 50 states and 13 stripes representing the original thirteen British colonies that constitute the first states. Moreover, international flags include the Flag of the United Nations, the Olympic flag, and the Paralympic flag.

Numerous means of printing known flag designs exist. By way of example, U.S. Patent Publication No. 2003/0217685 to Aldridge discloses a method for printing flags by transfer or sublimation printing. Aldridge's method teaches formulation of the flagpole sleeve after the design has been printed on the flag so as to improve production speed and efficiency. That being said, this Publication is deficient because it does not provide for a variety of designs that may be printed on the flags. Another example is U.S. Pat. No. 8,328,339 to Grasselli, which teaches a method and apparatus for digitally printing on two faces of a textile. While this Patent discloses the ability of two-face printing, it is lacking because it does not provide for printing of two different designs on the two faces of the textile fabric.

Overall, these disclosures are deficient because they do not provide for customization of the flags or fabrics being printed. Indeed, one problem that exists with today's flags is lack of customization. While there is an abundance of embodiments of various known flag designs, until now, individuals have been unable to add unique features or otherwise customize a flag design. At times, an individual may desire to alter a known flag design by adding his or her name, an avatar representing himself or herself, an emoji, or some other symbol or indicia that speaks to his or her personality. Thus, there is a need for a method of customizing flags that comprise preexisting designs or indicia and those that do not.

SUMMARY

The present disclosure is directed to a method for customizing flags with or without preexisting designs thereon.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In accordance with one embodiment, an exemplary method for flag customization may comprise the following, exemplary steps. First, a textile material may be provided and the textile material may have a first surface and a second surface. In certain embodiments, the textile material may be formed of nylon, polyester, or cotton. One skilled in the art will recognize numerous other types of fabrics or materials may form the textile material. Next, the textile material may be treated. For instance, the textile material may be sheared, scoured, singed or otherwise treated so as to remove any excess thread on the textile material. As another example, the textile material may also be hemmed to a desired dimension.

After the textile material is treated, at least one printing paste may be prepared. The at least one printing paste may be prepared by providing a coloring substrate, a thickening agent, a sequestrant, a surfactant, a humectant, a defoamer, and a catalyst. The coloring substrate may be either a dye or a pigment ink. In embodiments where the coloring substrate may be a dye, the dye may be natural or synthetic. Moreover, the dye may be vat, reactive, naphthol, or disperse. The dye may be used for printing on cotton, linen, silk, nylon, wool, leather, polyester, and plant-derived fibers. The pigment ink, on the other hand, may be used on a variety of fabric types and may be easily fixed to the textile material. The above-mentioned ingredients may be combined by heating, stirring, or otherwise mixing. Once the above-mentioned ingredients are sufficiently combined to form the at least one printing paste, the printing paste may be strained to remove any impurities therein. For instance, the printing paste may have lumps or other foreign objects that need to be removed prior to the remainder of the printing process.

Once the at least one printing paste has been prepared, the printing paste may be printed on the textile material in a desired design. As mentioned above, the textile material may have a preexisting design prior to the printing or it may have no design thereon prior to the printing. Moreover, in some embodiments, both the first surface and the second surface of the textile material may have a preexisting design thereon. In other embodiments, only the first surface of the textile material may have a preexisting design. The desired design may be fixed on the textile material through digital printing, screen printing, or heat transfer printing. A person of ordinary skill in the art will recognize other methods of printing may be implemented in accordance with this invention.

In embodiments where the desired design may be printed on the textile material using digital printing, an inkjet printer may first be provided. The inkjet printer may have an input end, an output end, and one or more print heads. The one or more print heads may contain the printing paste. The desired design may be rendered in a digital format that the inkjet printer may be able to decipher. The textile material may then be fed into the input end of the inkjet printer and the printing paste may be dispensed from the one or more print heads onto the first surface of the textile material, thereby forming the desired design. Finally, the textile material may be ejected from the output end of the inkjet printer.

In other embodiments where the desired design may be printed on the textile material using digital printing, a laser printer and a transfer sheet may first be provided. The laser printer may have an input end, an output end, and one or more print heads. The one or more print heads may contain the printing paste. The transfer sheet may be defined by a first surface and a second surface. The desired design may be rendered in a digital format that the laser printer may be able to decipher. The transfer sheet may then be fed into the input end of the laser printer and the printing paste may be dispensed from the one or more print heads onto the first surface of the transfer sheet, thereby forming the desired design. Next, the transfer sheet may be ejected from the output end of the laser printer. Finally, the first surface of the transfer sheet may be placed on top of the first surface of the textile material.

In still other embodiments where the desired design may be printed on the textile material using screen printing, a screen, a blocking stencil, and a squeegee blade may first be provided. The screen may be formed by a mesh material secured tautly over a rectangular frame and may further have a first surface and a second surface. The blocking stencil may have at least one aperture defined by at least one indicia visible thereon. The blocking stencil may be affixed to the first surface of the screen, such as by taping or gluing. Then, the textile material may be laid flat along a flat receiving surface. The first surface of the screen may next be desirably placed on the textile material. Once the screen has been desirably placed, the printing paste may be stroked on the second surface of the screen using the squeegee blade so as to press the printing paste through the first surface of the screen and the blocking stencil and onto the textile material. Finally, the screen may be removed.

In yet other embodiments, where the desired design may be printed on the textile material using heat transfer printing, a heat press and a transfer sheet may first be provided. The heat press may have an upper heat platen and a lower receiving platen. The transfer sheet may be defined by a first surface having a pre-printed desired design thereon and a second surface. The second surface of the textile material may then be placed on the lower receiving platen and the first surface of the transfer sheet may then be placed on the first surface of the textile material. Pressure may then be exerted between the upper heat platen and the lower receiving platen. Next, heat may be applied using the upper heat platen. In some embodiments, heat may be applied for 15 to 60 seconds. Moreover, in certain embodiments, the upper heat platen may apply heat in temperature range between 350 to 375 degrees Fahrenheit. After the heat has been applied, the pressure may then be released from the upper heat platen and the lower receiving platen.

The desired design may then be fixed on the textile material. In some embodiments, a fan, blow dryer, or other similar instrument may be used to speed up the natural drying process. In certain embodiments, the desired design may be fixed on the textile material by steaming the textile material. In other embodiments, the desired design may be fixed on the textile material by applying heat to the second surface of the textile material.

Finally, in some embodiments, the method for customizing flags may comprise the steps of: selecting a textile material; selecting a desired design, selecting a desired portion of the textile material for placement of the desired design; developing the desired design in a digital format, wherein a printer can decipher the digital format of the desired design; and digitally printing the desired design on the textile material.

In such embodiments, the textile material may be defined by a first surface and a second surface. Further, the first surface and/or the second surface may comprise a preexisting design, such as a national flag, team name, school name, or coat of arms. The desired design may include a name drop, quote or saying, fraternity, sorority, sticker, doodle, or other desirable indicia. Moreover, the desired portion upon which the desired design may be placed may comprise the first surface and/or the second surface of the textile material.

One or more of the above-disclosed embodiments, in addition to certain alternatives, are provided in further detail below with reference to the attached figures. The disclosed subject matter is not, however, limited to any particular embodiment disclosed.

Figure 1:
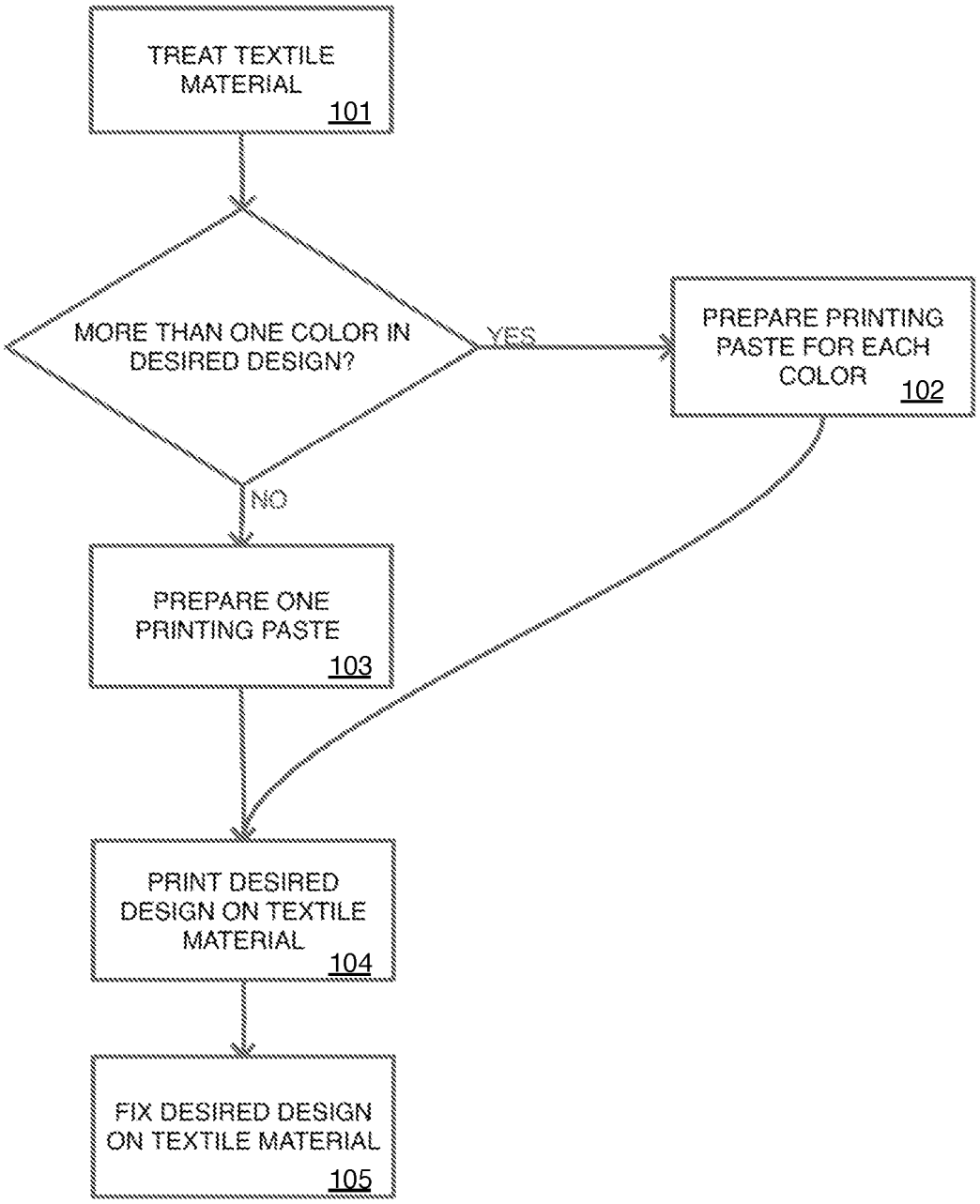
FIG. 1 shows a flowchart of an exemplary method of the present invention.

The disclosed embodiments may be better understood by referring to the figures in the attached drawings, as provided below. The attached figures are provided as non-limiting examples for providing an enabling description of the method claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

FIG. 1 is illustrative of an exemplary embodiment of a method for customization of flags. As shown, in FIG. 1, a method may include the following exemplary steps. First, a textile material may be provided. Next, the textile material may be treated (block 101) and at least one printing paste may be prepared (block 103). The printing paste may then be printed on the textile material in a desired design (block 104). Finally, the desired design may be fixed on the textile material (block 105).

In certain embodiments, the desired design may be externally driven in that the desired design may comprise virtually any color, combination of colors, shape, pattern, symbol, indicia, or other design as desired. For instance, some desired designs in accordance with this invention may comprise numerous colors. In such instances, more than one printing paste may be prepared (block 102) and each printing paste may correspond to each color of the desired design. In other embodiments, the desired design may comprise a single color and as such, only one printing paste may be provided.

The textile material may have a first surface and a second surface. Further, the textile material may be formed of nylon, polyester, or cotton. In some embodiments, the textile material may contain between about 50-100% polyester fiber. One of ordinary skill in the art will understand that the textile material may be formed out of numerous other types of fabric or materials. The textile material may be rectangular in shape. In other embodiments, the textile material may be square, triangular, circular, or virtually any other desirable shape. Moreover, in some embodiments, the first surface and/or the second surface of the textile material may be pre-printed with one or more indicia, such as a country's flag design, a coat of arms, symbols, logos, words, or other designs. In alternate embodiments, the textile material may appear blank with no pre-existing design thereon.

The textile material may be treated (block 101). For instance, if necessary, the textile material may be washed or bleached. In some embodiments, the textile material may be brushed or wiped so as to remove any loose nap, flocks, or dust thereon. Additionally, in the same vein, the textile material may be sheared, scoured, or singed so as to remove any excess thread thereon. If desired, the textile material may be first dyed in one or more desired colors. In certain embodiments, the textile material may be stretched, straightened, or ironed. The textile material may also be hemmed to a desired dimension.

Next, the printing paste may be prepared by first providing a coloring substrate, a thickening agent, a sequestrant, a surfactant, a humectant, a defoamer, and a catalyst (block 102/103). The coloring substrate utilized in preparing the printing paste may be a dye or a pigment ink. In embodiments where the coloring substrate may be a dye, the dye may be natural or synthetic and further may be vat, acid, reactive, naphthol, or disperse. The type of dye used may depend on the type of material forming the textile material. The dye may be used for printing on cotton, linen, silk, nylon, wool, leather, polyester, and plant-derived fibers. More particularly, in embodiments where an acid dye may be used, the textile material may be cotton, linen, rayon, silk, or wool. As another example, in embodiments where a disperse dye may be used, the textile material may be polyester. On the other hand, the pigment ink may be used on virtually any type material forming the textile material.

The thickening agent may provide the printing paste the proper viscosity in order to effectively imprint the desired design on the textile material. The thickening agent may also hold the desired design in place on the textile material, thereby preventing running or spreading of the colors associated therewith. In certain embodiments, the thickening agent may be native starch, a starch derivative, flour, guar gum derivatives, tamarind, sodium polyacrylate, carboxymethyl cellulose, Indalca, gum Tracaganth, British gum, sodium alginate, gum Arabic, gum Senegal, dextrin, albumen, foam, or an emulsion thickener.

The sequestrant may bond with metallic contaminants in the printing paste to prevent interference with the coloring substrate and other ingredients. In some embodiments, the sequestrant may be sodium hexametaphosphorate, zeolite, polycarboxylate, or ethylenediaminetetraacetic acid. The surfactant may be used to disperse solid particles built up in the printing paste and may facilitate the combination of the aforementioned ingredients. Moreover, the surfactant may promote stability of the printing paste and may increase penetration of the printing paste into the textile material. The surfactant may be anionic, cationic, or amphoteric. The humectant may prevent premature evaporation or skim over from the printing paste. The humectant may further absorb any moisture in the air to keep dry printing paste from cracking. Similar to the surfactant, the humectant may prevent instability of the printing paste. In some embodiments, the humectant may be ammonia, triethanolamine, polyalcohol, ethylene glycol, glycerine, urea, olive oil, or caster oil.

The defoamer may eliminate unwanted bubbles or foam that may form during the printing process. In certain embodiments, the defoamer may be a silicone compound, sulphated oil, organic and inorganic esters, emulsified pine oil, or aliphatic esters. The catalyst may accelerate the final development of the desired design. The catalyst may be copper sulfide, ammonium vanadate, or potassium ferrocyanide.

The coloring substrate, the thickening agent, the sequestrant, the surfactant, the humectant, the defoamer, and the catalyst may then be combined. The aforementioned ingredients may be combined through stirring, heating, boiling, or otherwise mixing. Once the aforementioned ingredients have been combined, thereby forming the printing paste, the printing paste may then be strained to remove any impurities therein, such as sand, dust, dirt, or other undesirable particles. The printing paste may be strained using a filter cloth, such as artisanal fine cotton, silk, or industrial woven nylon, or a fine sieve.

Once prepared, the printing paste may then be printed on the textile material in a desired design (block 104). The printing paste may be printed on the textile material through digital printing, screen printing, or heat transfer printing. A person of ordinary skill in the art will understand that the printing paste may be printed using other types of printing.

Figure 2:
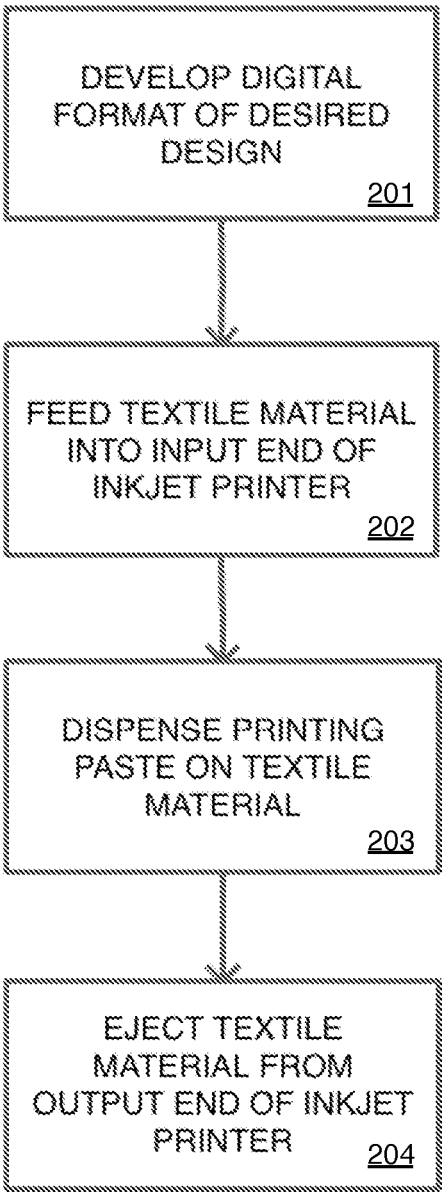
FIG. 2 shows a flowchart of an exemplary method of the present invention.
Figure 3:
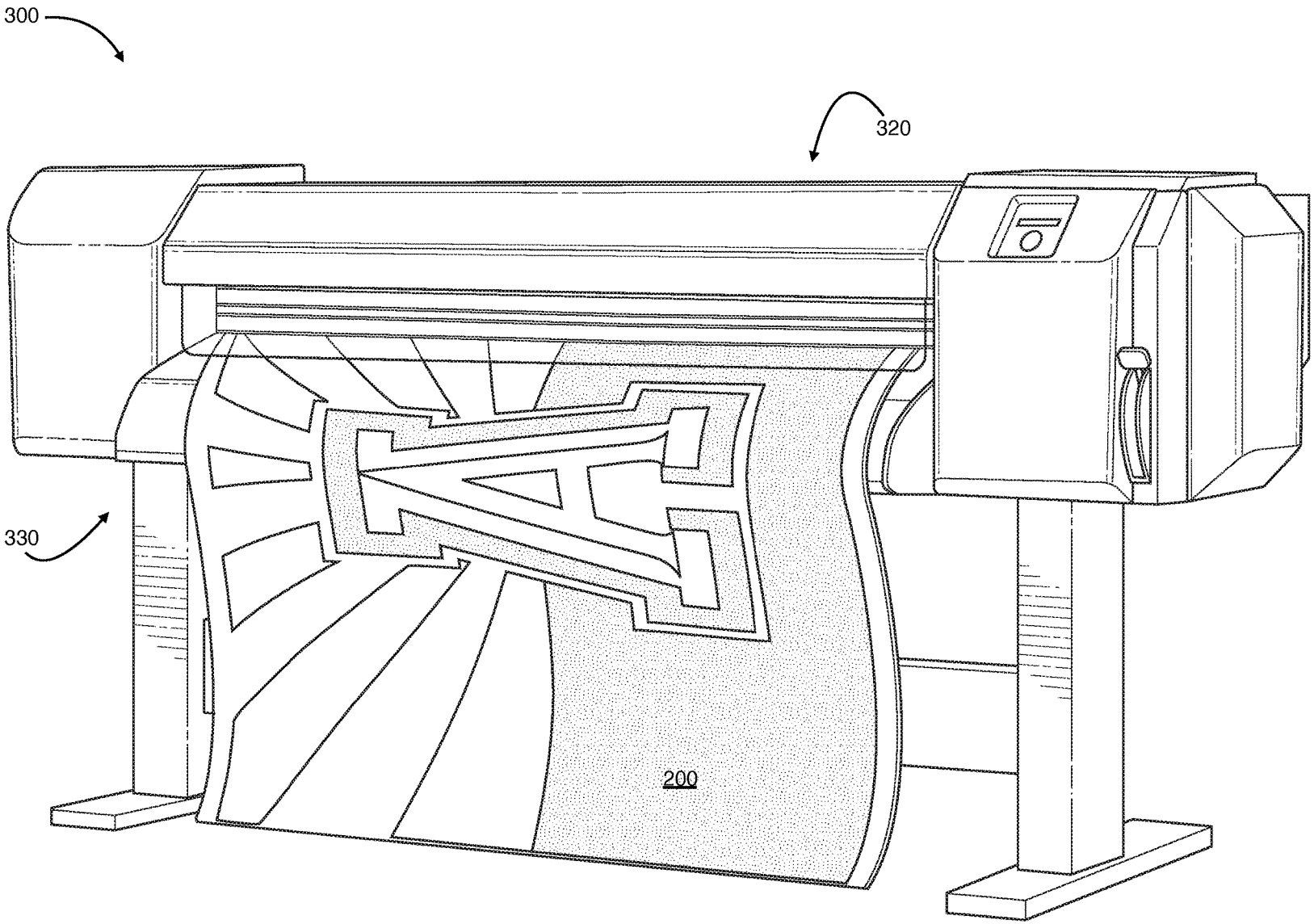
FIG. 3 shows an exemplary inkjet printer capable of carrying out an exemplary method of the present invention.

In embodiments where the printing paste is printed on the textile material using digital printing, as shown in FIG. 2, an inkjet printer may first be provided. FIG. 3 illustrates an exemplary inkjet printer 300 capable of printing the printing paste on the textile material 200. While one exemplary inkjet printer 300 is shown and described, one of ordinary skill in the art will recognize virtually any type of inkjet printer 300 may be provided, including those employing continuous inkjet technology, drop-on-demand technology, thermal bubble jet, piezoelectric inkjet, or pressure valve inkjets. The inkjet printer 300 may have an input end 320, an output end 330, and one or more print heads (not visible). The one or more print heads may be capable of containing and dispensing the printing paste. The inkjet printer 300 may be further capable of interpreting a digital format of the desired design.

Turning back to FIG. 2, the desired design may be developed in the digital format, which the inkjet printer, in turn, may read (block 201). The textile material may then be fed into the input end of the inkjet printer (block 202). The inkjet printer may then dispense the printing paste from the one or more print heads on to the first surface of the textile material (block 203). Once the desired design may have been fully printed on the first surface of the textile material, the textile material may be ejected from the output end of the inkjet printer (block 204).

Figure 4:
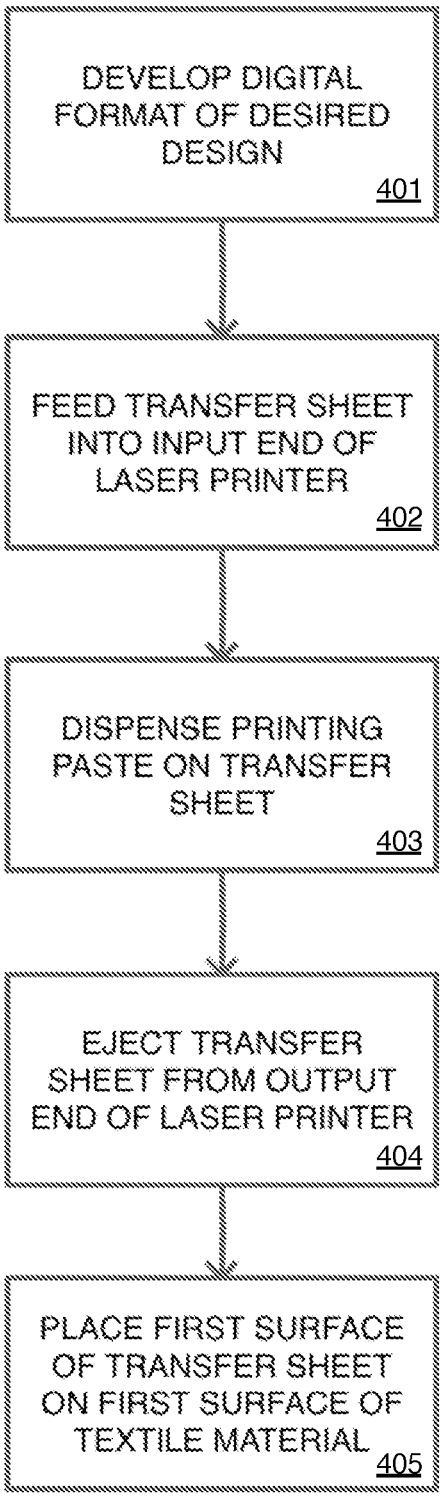
FIG. 4 shows a flowchart of an exemplary method of the present invention.

FIG. 4 illustrates another exemplary embodiment of a method wherein the printing paste may be printed on the textile material using digital printing. In such embodiments, a laser printer and a transfer sheet may first be provided. The laser printer may have an input end, an output end, and one or more print heads, and may be capable of interpreting a digital format of the desired design. The one or more print heads may be capable of containing and dispensing the printing paste. The transfer sheet may be defined by a first surface and a second surface.

The desired design may be developed in the digital format, which, as mentioned above, the laser printer may decipher (block 401). The transfer sheet may then be fed into the input end of the laser printer (block 402). Next, the printing paste may be dispensed from the one or more print heads on to the first surface of the transfer sheet (block 403). Once the desired design may have been fully printed on the first surface of the transfer sheet, the transfer sheet may then be ejected from the output end of the laser printer (block 404). Then, the first surface of the transfer sheet may then be placed on the first surface of the textile material (block 405).

Figure 5:
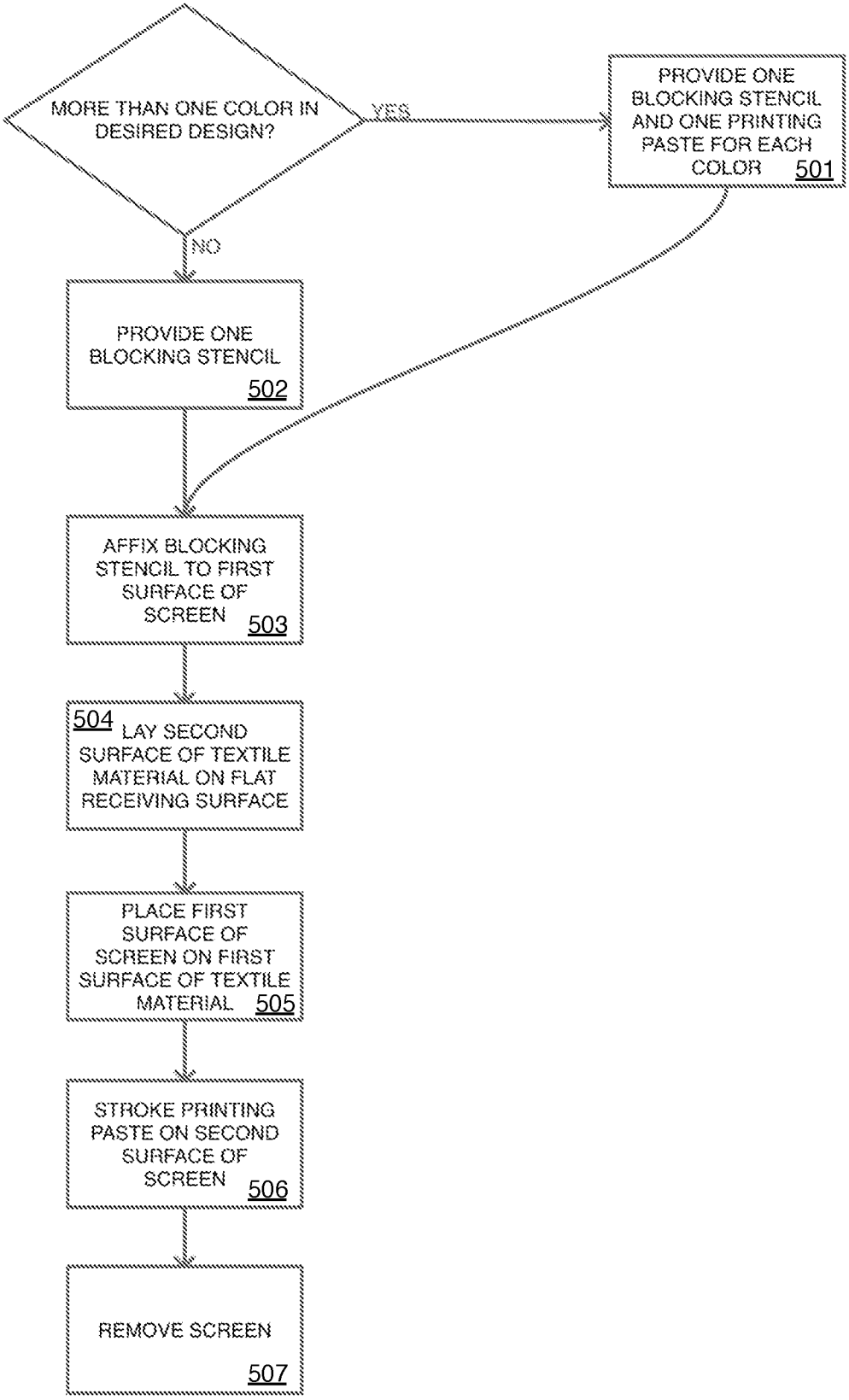
FIG. 5 shows a flowchart of an exemplary method of the present invention.

With attention now to FIG. 5, screen printing may be used to print the printing paste on the textile material. Screen printing may be optimal for embodiments wherein the desired design may comprise vibrant colors or the textile material may already be dark in color. In these embodiments, a screen, a blocking stencil, and a squeegee blade may first be provided. The screen may be defined by a mesh material and a rectangular frame and may have a first surface and a second surface. The mesh material may be 43T silk screen mesh, tulle, nylon blend fabric, or any other sheer fabric or material. The mesh material may be secured tautly over the rectangular frame. The blocking stencil may have at least one aperture defined by at least one indicia. The at least one indicia may correspond to at least a portion of the desired design. Further, as discussed above, some embodiments of the desired design in accordance with this invention may comprise numerous colors. In such instances, more than one blocking stencil may be provided (block 501) and each blocking stencil may correspond to each color of the desired design. In other embodiments, the desired design may comprise a single color and as such, only one blocking stencil may be provided (block 502).

The blocking stencil may be affixed to the first surface of the screen (block 503). Then, the second surface of the textile material may be laid flat a long a flat receiving surface, such as a table, counter, an ironing board, or even the floor (block 504). Once the textile material has been laid flat, the first surface of the screen may then be placed in a desired location on the first surface of the textile material (block 505). The printing paste may then be stroked on the second surface of the screen using the squeegee blade so as to press the printing paste through the first surface of the screen and the blocking stencil onto the first surface of the textile material (block 506). Lastly, the screen may be removed (block 507).

Figure 6:
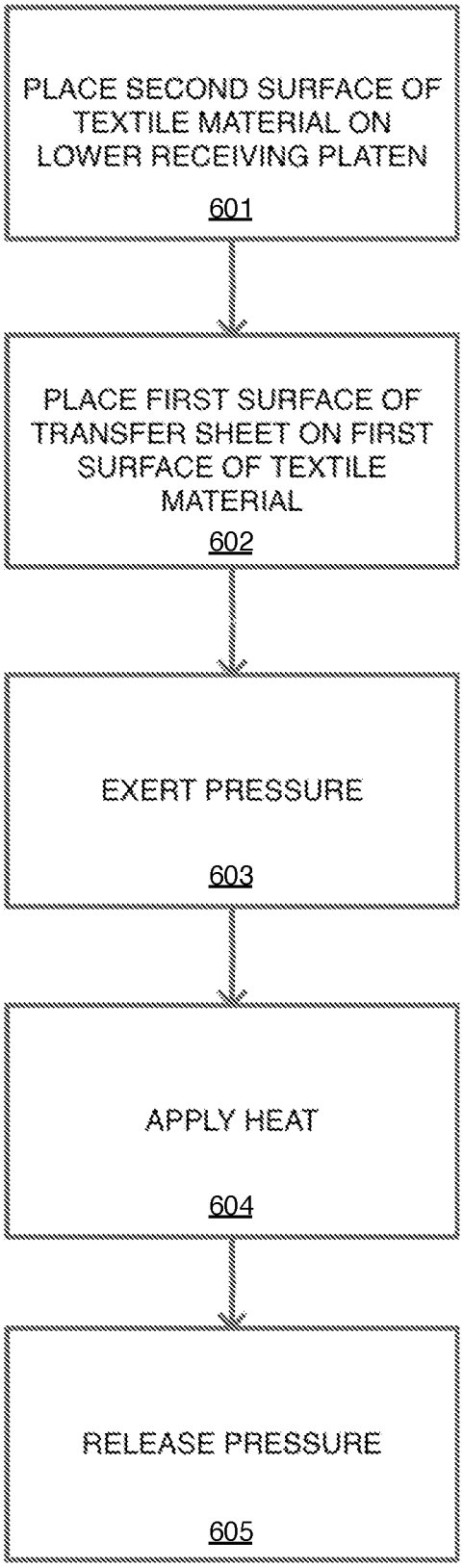
FIG. 6 shows a flowchart of an exemplary method of the present invention.

FIG. 6 shows an embodiment where the printing paste may be printed on the textile material using heat transfer printing. In these embodiments, a heat press and a transfer sheet may be provided. Any number and forms of heat presses may be used in accordance with this invention. Generally, however, the heat press may have an upper heat platen and a lower receiving platen. In some embodiments, the upper heat platen may be formed of aluminum. In other embodiments, other metals or materials capable of retaining heat may comprise the upper heat platen. In still other embodiments, the upper heat platen may comprise a separate heating element attached thereto. The transfer sheet may have a first surface and a second surface. The first surface of the transfer sheet may have a pre-printed desired design thereon. The pre-printed desired design may be externally driven and may comprise virtually any color, combination of colors, shape, pattern, symbol, indicia, or other design as desired. Moreover, the pre-printed desired design may appear inverted on the first surface of the transfer sheet as printing on the textile material may cause the pre-printed desired design to appear uninverted.

The second surface of the textile material may then be placed on the lower receiving platen (block 601). Next, the first surface of the transfer sheet may be placed on the first surface of the textile material (block 602). Pressure may then be exerted between the upper heat platen and the lower receiving platen (block 603). In some embodiments, pressure may be exerted manually such as by a user forcing the upper heat platen and the lower receiving platen together. In other embodiments, the heat press may automatically exert pressure. Then, heat may be applied using the upper heat platen (block 604). In certain embodiments, heat may be applied in the temperature range of 350 to 375 degrees Fahrenheit. In alternate embodiments, a greater or lesser degree of heat may be applied. Moreover, in some embodiments, heat may be applied for about between fifteen to sixty seconds. One of ordinary skill in the art may recognize heat may be applied for shorter or longer periods of time in order to fix the desired design on the textile material. Once heat has been sufficiently applied, the pressure may be released between the upper heat platen and the lower receiving platen (block 605).

Turning back to FIG. 1, once the desired design has been printed on the textile material, the desired design may be fixed on the textile material (block 105). In some embodiments, the desired design may be fixed on the textile material by allowing the textile material to naturally air dry. In other embodiments, the desired design may be fixed by using hot air on the textile material. For instance, a tenter frame, conveyor-belt dryer, or a loop dryer may be used to continuously dry the textile material. In alternate embodiments, the desired design may be fixed on the textile material by steaming the textile material. Further, the textile material may be steamed using atmospheric or pressure steaming. In still other embodiments, the desired design may be fixed on the textile material by applying heat, such as with an iron, to the second surface of the textile material.

Figure 7:
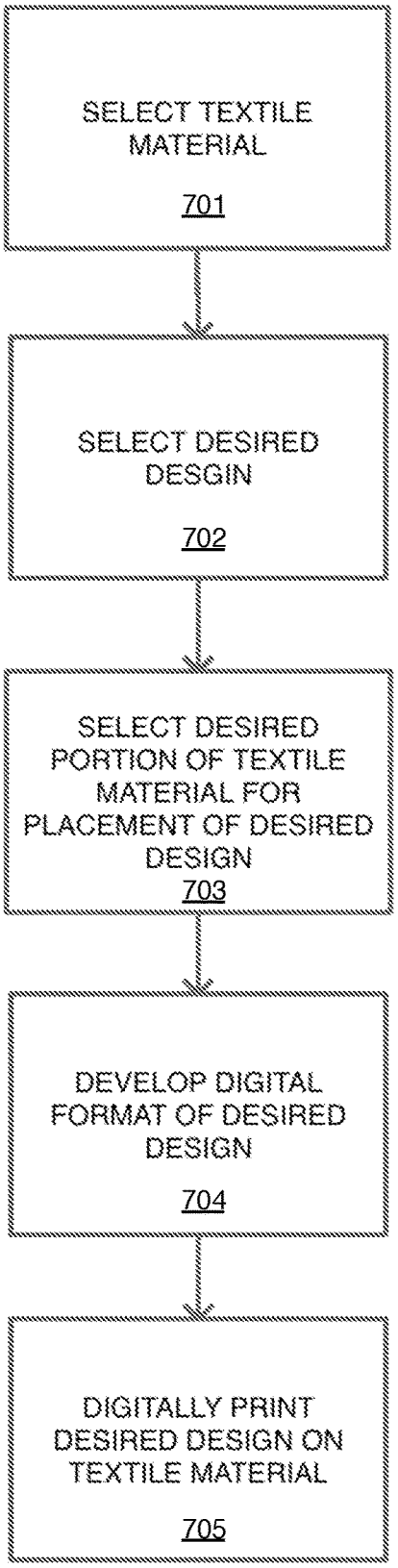
FIG. 7 shows a flowchart of an exemplary method of the present invention.

Finally, FIG. 7 shows another embodiment of a method for customizing flags. In such embodiment, a textile material may first be selected (block 701). The textile material may be defined by a first surface and a second surface. The first surface and/or the second surface may comprise a preexisting design. One of ordinary skill in the art will appreciate that the preexisting design may comprise virtually any color, pattern, symbol, or indicia. For instance, the preexisting design may comprise a national flag, a coat of arms, or a school name. Next, a desired design may be selected (block 702). As discussed above, a person of ordinary skill in the art will understand that the desired design may be externally driven in that the desired design may comprise virtually any color, combination of colors, shape, pattern, symbol, indicia, or other design as desired.

Once the desired design has been selected, a desired portion of the textile material may be selected for placement of the desired design (block 703). The desired portion may comprise the first surface, the second surface, and/or or a portion thereof. The desired design may then be developed in a digital format, wherein a printer may be capable of deciphering the digital format of the desired design (block 704). Finally, the desired design may be digitally printed on the textile material (block 705). The printer may be an inkjet printer or a laser printer, as discussed above, or any other type of printer capable of deciphering the digital format of the desired design and digitally printing the same on the textile material. Moreover, the digital printing may be accomplished using any of the methods discussed with regards to FIGS. 1, 2, and 4, above.

Other steps may be practiced to provide a customized flag. Additional steps may include first applying a pretreatment solution to the textile material to prepare the textile material to accept dye or after-washing the textile material subsequent to printing, especially in embodiments wherein the dye may be the coloring substrate. Further steps may include hemming the textile material subsequent to printing or forming a pole sleeve or pocket along one edge of the textile material so the flag may be mounted on a pole.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. Accordingly, it is intended that the invention not be limited, except as by the appended claims.

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the method for flag customization with which that terminology is associated. In general, the terms used in the following claims should not be constructed to limit the method for flag customization to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the method for flag customization is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the method for flag customization.

What is claimed is:

1. A method for customizing flags, comprising the steps of:

providing a textile material having a first surface and a second surface, wherein the textile material is formed of nylon, polyester, or cotton, and one or more of the first surface and the second surface has at least one preexisting indicia or design visible thereon;

treating the textile material;

preparing at least one printing paste;

printing the at least one printing paste on the textile material in a desired design; and fixing the desired design on the textile material.

2. The method of claim 1, wherein the textile material is treated by shearing, scouring, or singeing any excess thread on the textile material; and hemming the textile material to a desired dimension.

3. The method of claim 1, wherein the printing paste is prepared by providing a coloring substrate;

a thickening agent;

a sequestrant;

a surfactant;

a humectant;

a defoamer;

a catalyst;

combining the coloring substrate, the thickening agent, the sequestrant, the surfactant, the humectant, the defoamer, the catalyst, thereby forming the printing paste; and straining the printing paste to remove any impurities therein.

4. The method of claim 3, wherein the coloring substrate is a dye.

5. The method of claim 3, wherein the coloring substrate is a pigment ink.

6. The method of claim 1, wherein the printing paste is printed on the textile material by digital printing.

7. The method of claim 6, wherein digital printing further comprises the steps of:

providing an ink jet printer, having an input end, an output end, and one or more print heads, wherein the one or more print heads contain the printing paste;

developing the desired design in a digital format, wherein the inkjet printer can decipher the digital format of the desired design;

feeding the textile material into the input end of the ink jet printer;

dispensing the printing paste from the one or more print heads on the first surface of the textile material, thereby forming the desired design; and ejecting the textile material from the output end of the inkjet printer.

8. The method of claim 1, wherein the desired design is fixed on the textile material by steaming the textile material.

9. The method of claim 1, wherein the desired design is fixed on the textile material using hot air on the textile material.

* * * * *